US008235485B2

(12) United States Patent
Matsui et al.

(10) Patent No.: US 8,235,485 B2
(45) Date of Patent: Aug. 7, 2012

(54) ELEMENT SUBSTRATE, PRINTHEAD, HEAD CARTRIDGE, AND PRINTING APPARATUS

(75) Inventors: Takahiro Matsui, Yokohama (JP); Yoshiyuki Imanaka, Kawasaki (JP); Souta Takeuchi, Yokohama (JP); Takuya Hatsui, Tokyo (JP); Takaaki Yamaguchi, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 856 days.

(21) Appl. No.: 12/111,039

(22) Filed: Apr. 28, 2008

(65) Prior Publication Data

US 2008/0309692 A1 Dec. 18, 2008

(30) Foreign Application Priority Data

May 1, 2007 (JP) ..... 2007-121161
Mar. 28, 2008 (JP) ..... 2008-088263

(51) Int. Cl.
*B41J 29/38* (2006.01)

(52) U.S. Cl. ..... 347/9

(58) Field of Classification Search ..... 347/9
See application file for complete search history.

(56) References Cited

U.S. PATENT DOCUMENTS

| | | | | |
|---|---|---|---|---|
| 5,175,565 | A | 12/1992 | Ishinaga | |
| 6,234,599 | B1 | 5/2001 | Ishinaga | |
| 6,439,680 | B1 | 8/2002 | Mochizuki | |
| 6,505,907 | B2 | 1/2003 | Ishinaga | |
| 6,598,952 | B2 | 7/2003 | Ishinaga | |
| 7,055,923 | B2 | 6/2006 | Mochizuki | |
| 7,108,345 | B2 | 9/2006 | Mochizuki | |
| 2003/0155585 | A1 * | 8/2003 | Kozuka et al. | 257/200 |

FOREIGN PATENT DOCUMENTS

| | | | |
|---|---|---|---|
| JP | 2-258266 | A | 10/1990 |
| JP | 2001-058412 | A | 3/2001 |

* cited by examiner

*Primary Examiner* — Uyen Chau N Le
*Assistant Examiner* — Hoang Tran
(74) *Attorney, Agent, or Firm* — Canon U.S.A., Inc. IP Division

(57) ABSTRACT

The present invention prevents an element substrate from not operating normally in the case where the voltage supply from a power supply that applies a voltage to a logic circuit is unstable. The element substrate of the invention has unit for applying a first voltage to the logic circuit, and unit capable of applying a second voltage that is lower than the first voltage and capable of operating the logic circuit.

20 Claims, 20 Drawing Sheets

ELEMENT SUBSTRATE, PRINTHEAD, HEAD CARTRIDGE, AND PRINTING APPARATUS

BACKGROUND OF THE INVENTION

1. Field of the Invention

The present invention relates to an element substrate that is used in an inkjet printhead or the like and has an electrothermal transducer that produces discharge energy, a switching element for driving the electrothermal transducer and a logic circuit that controls the switching element, and to a printhead having such an element substrate, a head cartridge and a printing apparatus.

2. Description of the Related Art

An inkjet printhead that utilizes thermal energy to discharge ink drops is able to realize a high density multi-nozzle configuration relatively easily, thereby enabling high resolution, high quality and high speed printing. One known method of discharging ink using this type of thermal energy is a side-shooter printhead that discharges ink drops vertically upwards of a surface on which an electrothermal transducer that produces thermal energy is formed. Generally, with this type of printhead, ink for discharging is supplied from the underside of an element substrate provided with the electrothermal transducer via an ink supply port that passes through the element substrate.

An element substrate mounted on a common inkjet printhead will now be described. For illustrative purposes, the printhead of a printing apparatus is used as a terminal for various types of output. Moreover, an electrothermal transducer, an element that switches this electrothermal transducer between drive or non-drive (hereinafter, switching element), and a circuit for driving the switching element have been mounted on the same substrate. However, this configuration of inkjet is exemplary in nature and is not intended.

FIG. 6 is a schematic cross-sectional view showing part of an element substrate for a conventional printhead. Reference numeral 1 denotes a p-type semiconductor substrate composed of single crystal silicon. Reference numeral 112 denotes a p-type well region, 8 denotes an n-type drain region, 116 denotes an n-type field relaxation drain region, 7 denotes an n-type source region, and 4 denotes a gate electrode. These form a switching element that uses a metal insulator semiconductor (MIS) field-effect transistor 130. Reference numeral 117 denotes a silicon oxide layer as a thermal storage layer and an insulating layer, 141 denotes a tantalum nitride film as an electrothermal transducer, 154 denotes an aluminum alloy film as wiring, and 120 denotes a silicon nitride film as a protective layer. The above form a substrate 152 of the printhead. Here, reference numeral 150 denotes a heat producing portion, and ink is discharged from an ink discharging portion 153. A top plate 156 forms a liquid channel 155 in cooperation with the substrate 152.

Incidentally, there is increased demand for faster driving, greater energy efficiency, higher integration, lower cost, and higher performance with respect to products in recent years. A configuration is thus known in which a plurality of MIS field-effect transistors 130 utilized as switching elements such as shown in FIG. 6 are built into the semiconductor substrate 1, and the electrothermal transducer is driven by operating one of these MIS field-effect transistors 130 alone or operating a plurality of them simultaneously.

However, while a large current flows in order to drive the electrothermal transducer, leakage current sometimes occurred due to the pn reverse bias junction between the drain and the well not being able to withstand the high electric field when the conventional MIS field-effect transistors 130 are operated. In such cases, the voltage proof required of a switching element could not be satisfied. Further, when an MIS field-effect transistor utilized as a switching element has a large on-resistance, the current required to drive the electrothermal transducer is reduced as a result of wasted current consumption.

In view of this, an MIS field-effect transistor 20 such as shown in FIG. 7 is conceivable in order to solve the problem of voltage proof. The structure of the MIS field-effect transistor 20 shown in FIG. 7 differs from a normal structure, with part of an n-type well region 2 in a p-type semiconductor 1 formed as a drain by enclosing the n-type source region 7 with an p-type base region 5. This is called a double diffused metal oxide semiconductor (DMOS) transistor. The drain determining the voltage proof can thus be built in deep and at low density by building a channel into the drain utilizing the n-type well region 2, thereby enabling the voltage proof problem to be solved.

Next, a level shift circuit utilized in a driver IC for driving the electrothermal transducers will be described. The method of transmitting the drive signals of the driver IC will be described using FIG. 8. First, an input signal of 5.0V to 3.3V, for example, is input to the element substrate as a high level. This signal is transmitted to a desired bit by a decoder. This signal then passes through a source inverter circuit with a CMOS configuration, and is input to the gate of a MOS transistor utilized as a switching element.

As shown in FIGS. 8 and 10, VDD denotes a power supply line input to an AND circuit and VSS denotes a terminal wired for a ground.

It is noted that a predetermined voltage VHT provided to the CMOS inverter circuit. The voltage VHT is set so that the on-resistance during the MOS transistor drive is minimized, since minimizing the on-resistance of the MOS transistor enables the size of the MOS transistor utilized as a switching element to be minimized.

The voltage level thus generally needs to be transformed in the driver IC. A level shift circuit that connects a plurality of diodes DIODE1, DIODE 2, . . . DIODEn in series in the forward direction as shown in FIG. 9 is given as an exemplary level shift circuit for transforming the voltage level. While there are also methods of thus obtaining a desired constant voltage, multiplying the characteristic variation of one diode gives the total variation. Further, the diodes need to be large in order to prevent current-dependent voltage fluctuation. Therefore, this cannot be considered a realizable method.

In view of this, a level shift circuit that obtains a desired constant voltage by interposing a source follower transistor is given as a level shift circuit generally used. FIG. 10 shows the configuration of a circuit that interposes a source follower transistor in the circuit shown in FIG. 8.

Assume that in the circuit shown in FIG. 10, a drain voltage VH for driving the MOS transistor utilized as a switching element is 30V, VGNDH is 0V, and a gate voltage VHT is 12V. In this case, a −12V back gate voltage is applied to the source follower transistor utilized as a level shift element, and we know that a drain-source voltage proof of at least 18V is required.

FIG. 11 is a top view showing the arrangement of elements on an element substrate 101 for an inkjet printhead. Switching elements 41 and electrothermal transducers 103 having the configurations shown in FIG. 7, and a level shift circuit 49 that includes a level shift element such as shown in FIG. 10 are formed on the element substrate 101. A plurality of pads (terminals) 104, a level shift circuit input voltage pad 105 utilized for receiving supply of input voltages for the level shift circuit 49 and drive signals for the switching elements 41 from an external source, and an ink supply port forming portion 107 are also formed on the element substrate 101.

A plurality of electrothermal transducers 103 (such as 256 quantity, for example) constituting nozzles are provided in two rows over an interval of 1200 dpi (dots per inch) with the ink supply port forming portion 107 sandwiched therebetween. Ink channels (not shown) are formed on the ink supply port forming portion 107 and the electrothermal transducers 103. The element substrate 101 is combined with a top plate (not shown), and ink discharge orifices are formed in the top plate at positions corresponding to the electrothermal transducers 103. Heating the electrothermal transducers 103 by applying a voltage thereto causes ink on the electrothermal transducers 103 to foam and be discharged from the discharge orifices as a result of this energy.

FIG. 12 is a top view showing the arrangement of elements on an element substrate 101 formed with more nozzles than the element substrate of FIG. 11. In the example shown in FIG. 12, at least 512 electrothermal transducers 103 are provided over an interval of 1200 dpi, with two level shift circuits 49 being provided to accommodate this.

FIG. 13 is a circuit diagram showing a detailed configuration of a circuit configured on an element substrate such as shown in FIG. 11 or 12. Reference numeral 41 denotes a switching element, 49 denotes a level shift circuit, 50 denotes a logic gate array, and 52 denotes a level converter. The switching element 41, the logic gate array 50, the level converter 52 and a latch circuit are respectively disposed in parallel on a single chip.

Although a plurality of level converters are provided in relation to the switching elements, and one level shift circuit is provided in relation to a plurality of switching elements on the actual element substrate, one each of both the level converter and the level shift circuit are shown here.

Digital image signals input from the DATA terminal are rearranged in parallel by a shift register, and then latched with the latch circuit. When the logic gate is enabled, the switching elements 41 are turned on or off according to the signals latched in the latch circuit, and current flows to selected electrothermal transducers.

It is noted that the DMOS transistor shown in FIG. 7 is suitably used as the above switching elements.

Incidentally, there is an element substrate for a inkjet printhead that enables high precision reading of element substrate temperature by building a temperature sensor into the element substrate, as disclosed in Japanese Patent Publication Laid-open No. H2-258266. This temperature sensor is applied when controlling the ink discharge characteristics. Further, it is also known to apply the temperature sensor in cases such where a sequence is forcibly interrupted using a monitor value of the temperature sensor when an abnormality of some description occurs on the substrate, such as a power short circuit, causing the substrate temperature to be abnormally high.

U.S. Pat. No. 6,439,680 discloses an example in which a prescribed voltage generation circuit is provided in the case where noise occurs in an input voltage from an external source supplied to the head, such as a heater application voltage or the like, for example, or where a drop in the input voltage occurs. Since the output voltage is maintained substantially constant by the prescribed voltage generation circuit, a heater application voltage with little fluctuation relative to the noise input or the external voltage drop can be applied to the heaters.

The number of nozzles constituting printheads had been increasing year by year in response to high speed, high quality printing in recent years. There have tended to be further increases in the number of ink supply ports provided on a single element substrate in order to cope with multi-color inks. At the same time, the number of level shift circuits themselves has to be increased if there is an increase in the number of nozzles driven simultaneously, given that the level shift circuits supply power to the switching elements for switching the electrothermal transducers. On the other hand, despite the number of nozzles tending to increase as described above, there is greater demand for energy efficiency and cost reduction. That is, element substrate miniaturization and on-resistance reduction is ongoing. By utilizing DMOS transistors as switching elements, the current is reduced using a high voltage drive that takes advantage of the characteristics of high voltage proof and the like to realize energy savings and cost reductions, and to also achieve miniaturization.

On the other hand, similarly in relation to logic circuits utilized in cases such as where a specific electrothermal transducer is selected from a plurality of electrothermal transducers, advances are being made in high densification to cope with high speed, high quality printing at low cost. At the same time, advances are now also being made in voltage reduction from the viewpoint of energy efficiency. In the case where a voltage is not applied to a logic circuit because the power supply that applies the voltage has failed for some reason, the logic of the logic circuit becomes unstable, creating the possibility of unnecessary voltages being applied to the electrothermal transducers or switching elements. When this happens, the element substrate may also not function normally due to the logic of the element substrate getting out of control, resulting in abnormal printing or the like.

The foregoing U.S. Pat. No. 6,439,680 discloses a prescribed voltage application circuit that is provided on wiring that directly connects the heater with the input terminal to the heater. This configuration expressly requires space for providing a prescribed voltage application circuit on the head.

SUMMARY OF THE INVENTION

The present invention is directed to an element substrate, a printhead, a head cartridge, and a printing apparatus.

One aspect of the present invention is to allow a printhead and an element substrate thereof to operate normally even if the voltage supply from a power supply that applies a voltage to a logic circuit becomes unstable.

According to another aspect of the present invention, there is provided an element substrate provided with a printing element, a switching element that drives the printing element, and a logic circuit that supplies a drive signal to the switching element. The substrate further includes a first terminal that applies a first voltage to the logic circuit; a preliminary voltage input circuit capable of applying to the logical circuit a second voltage that is lower than the first voltage and capable of operating the logic circuit; and a preliminary voltage application control circuit that applies a voltage to the logic circuit from the preliminary voltage input circuit, if a voltage applied to the logic circuit by the first terminal becomes lower than the second voltage.

According to another aspect of the present invention, preferably, there is provided a printhead comprising an element substrate provided with a printing element, a switching element that drives the printing element, and a logic circuit that supplies a drive signal to the switching element. The element substrate includes a first terminal that applies a first voltage to the logic circuit; a preliminary voltage input circuit capable of applying to the logical circuit a second voltage that is lower than the first voltage and capable of operating the logic circuit; and a preliminary voltage application control circuit that applies a voltage to the logic circuit from the preliminary voltage input circuit, if a voltage applied to the logic circuit by the first terminal becomes lower than the second voltage.

According to still another aspect of the present invention, preferably, there is provided a head cartridge comprising an ink tank containing ink, and a printhead having an element substrate provided with a printing element, a switching element that drives the printing element, and a logic circuit that supplies a drive signal to the switching element. The element substrate includes a first terminal that applies a first voltage to the logic circuit; a preliminary voltage input circuit capable of applying to the logical circuit a second voltage that is lower than the first voltage and capable of operating the logic circuit; and a preliminary voltage application control circuit that applies a voltage to the logic circuit from the preliminary voltage input circuit, if a voltage applied to the logic circuit by the first terminal becomes lower than the second voltage.

According to still another aspect of the present invention, preferably, there is provided a printing apparatus comprising a printhead having an element substrate provided with a printing element, a switching element that drives the printing element, and a logic circuit that supplies a drive signal to the switching element. Here, the element substrate includes a first terminal that applies a first voltage to the logic circuit; a preliminary voltage input circuit capable of applying to the logical circuit a second voltage that is lower than the first voltage and capable of operating the logic circuit; and a preliminary voltage application control circuit that applies a voltage to the logic circuit from the preliminary voltage input circuit, if a voltage applied to the logic circuit by the first terminal becomes lower than the second voltage.

The invention is particularly advantageous since it enables abnormal printing and printhead damage to be prevented with minor improvement to the drive power voltage generation portion of a switching element, without increasing the chip size of the printhead, even in the case where an abnormality occurs in the power supply that applies a voltage to a logic circuit.

Further features of the present invention will become apparent from the following description of exemplary embodiments (with reference to the attached drawings).

DESCRIPTION OF THE EMBODIMENTS

Figure 1:
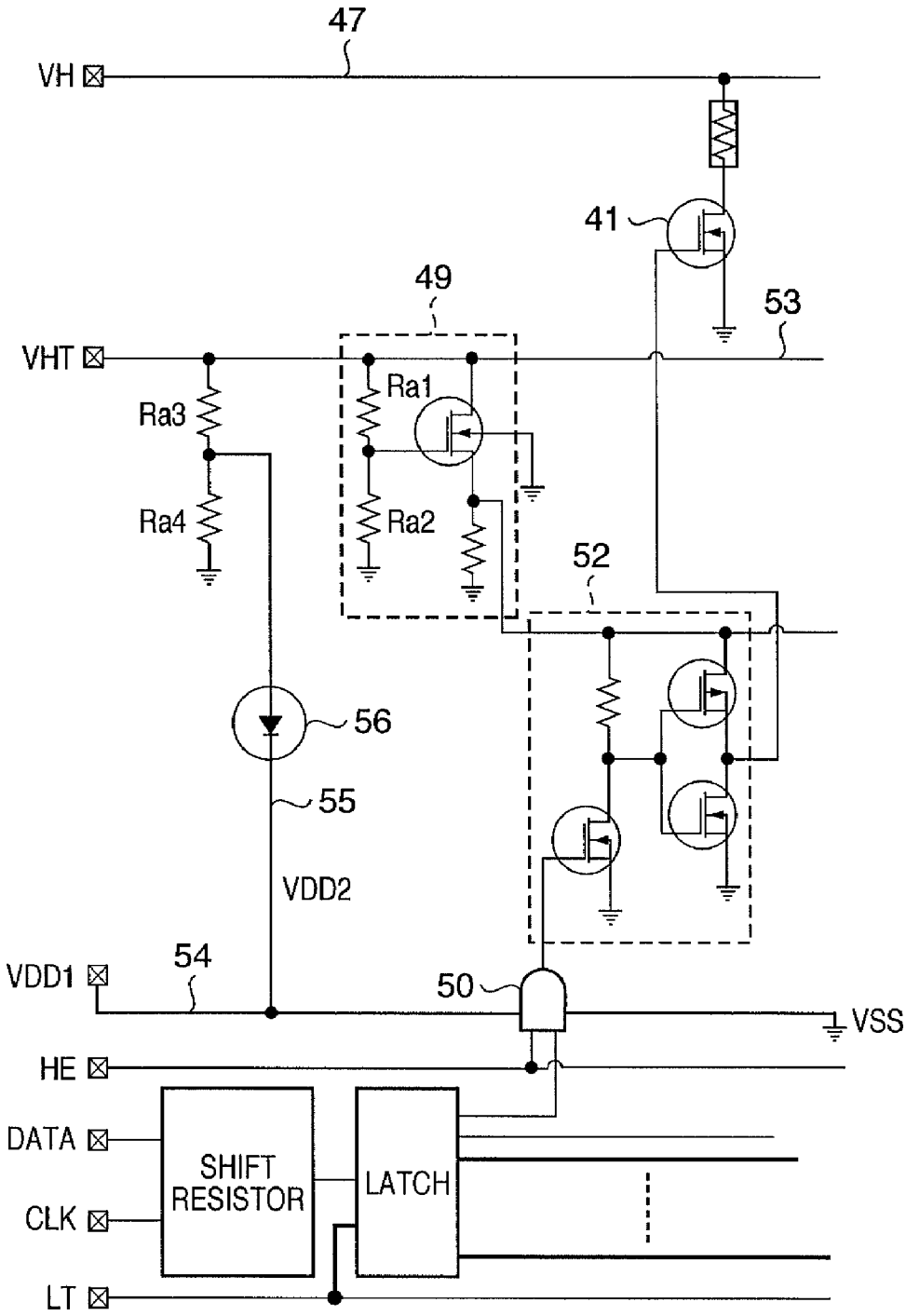
FIG. 1 shows an example circuit configuration according to a first exemplary embodiment of the present invention.

Numerous embodiments, features and aspects of the present invention will now herein be described in detail with reference to the drawing.

Exemplary Inkjet Printing Apparatus

Figure 14:
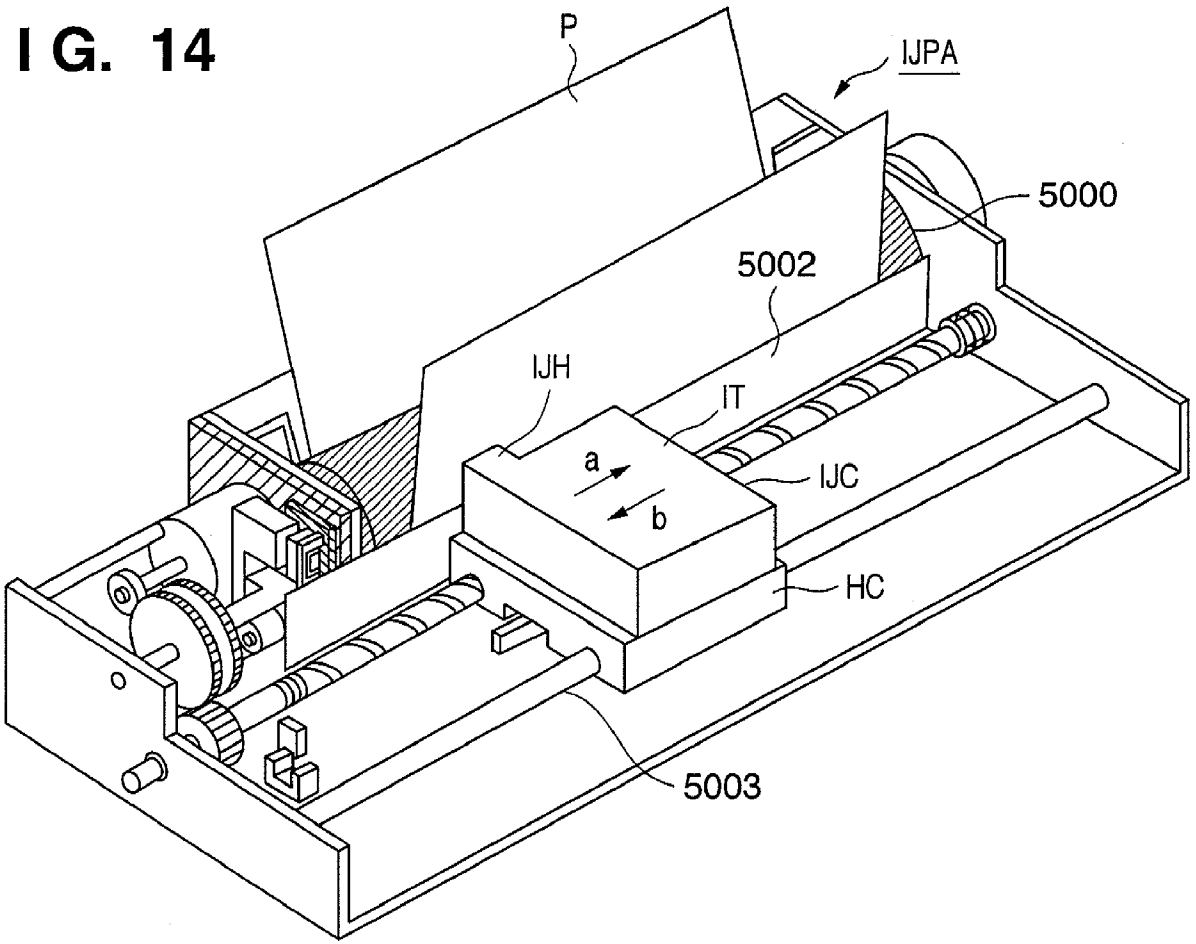
FIG. 14 shows an overview of the configuration of a common inkjet printing apparatus.

FIG. 14 is an external perspective view showing an overview of the configuration of an example inkjet printing apparatus (IJPA) which is a representative aspect of an embodiment of the invention.

In FIG. 14, a carriage HC has a pin (not shown), and reciprocates in a main scan direction (direction of arrows a, b) supported by a guide rail 5003. An integrated inkjet cartridge IJC having a built-in printhead IJH and ink tanks IT containing ink is mounted on the carriage HC. Reference numeral 5002 is a bail plate that presses the print medium P against a platen 5000 over the reciprocation direction of the carriage HC.

Figure 15:
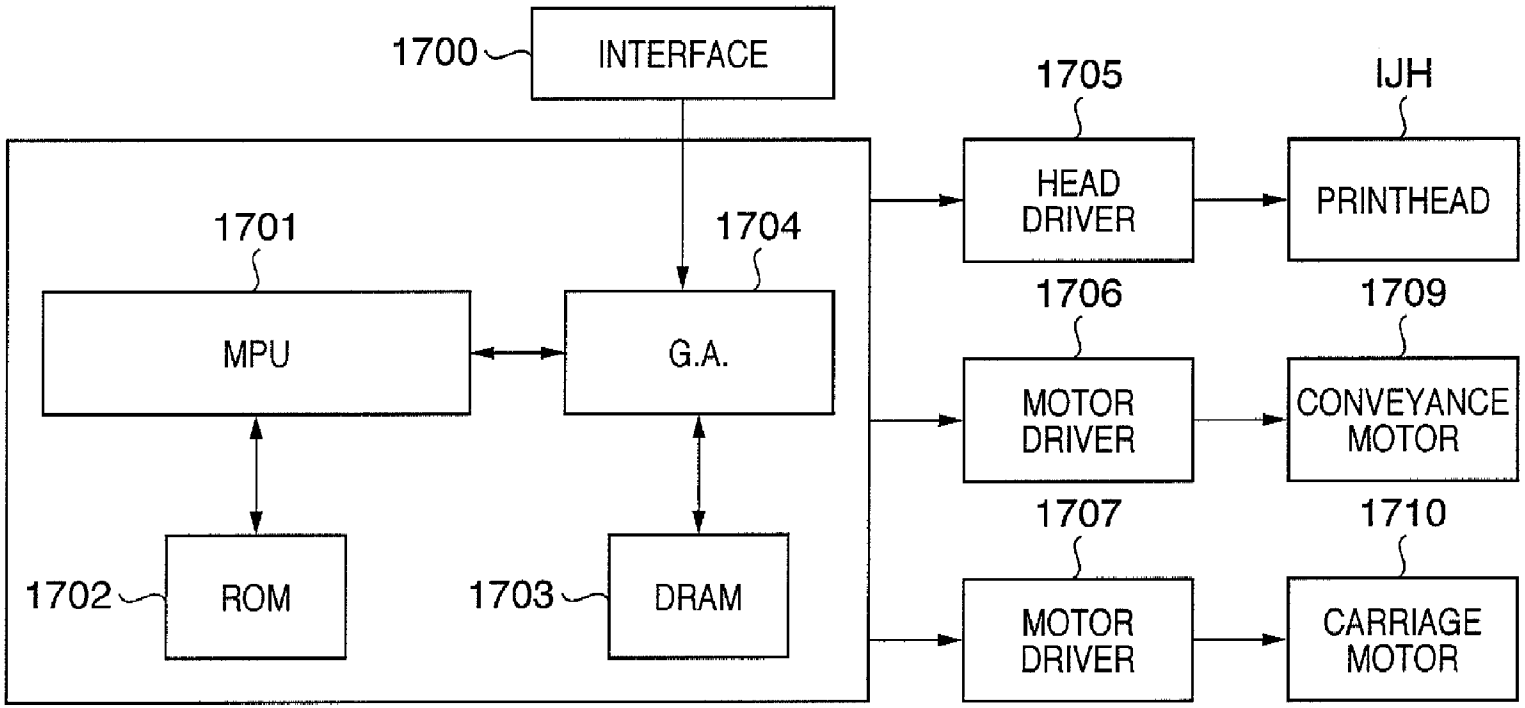
FIG. 15 shows a control configuration of a common inkjet printing apparatus.

Next, an example control configuration for executing print control of the above apparatus will be described. FIG. 15 is a block diagram showing the configuration of a control circuit of the inkjet printing apparatus (hereinafter, also referred to as "the printer") IJPA.

In FIG. 15, reference numeral 1700 denotes an interface that inputs print signals, 1701 denotes an MPU, and 1702 denotes a ROM that stores control programs executed by the MPU 1701. Reference numeral 1703 denotes a DRAM that saves various types of data (print signals, print data to supply to the printhead IJH, etc.). Reference numeral 1704 denotes a gate array (G. A.) that controls supply of print data to the printhead IJH, and also controls data transfer between the interface 1700, the MPU 1701 and the DRAM 1703. Reference numeral 1710 denotes a carriage motor for conveying the printhead, and 1709 denotes a conveyance motor for conveying the print medium. Reference numeral 1705 denotes a head driver that drives the printhead IJH, 1706 denotes a motor driver for driving the conveyance motor 1709, and 1707 denotes a motor driver for driving the carriage motor 1710.

In terms of the operation of the above control configuration, a print signal, having been input to the interface 1700, is converted to print data for a printer between the gate array 1704 and the MPU 1701. The printhead IJH is driven in accordance with print data sent to the motor driver 1705, together with the driving of the motor drivers 1706 and 1707, and printing is performed.

Figure 19:
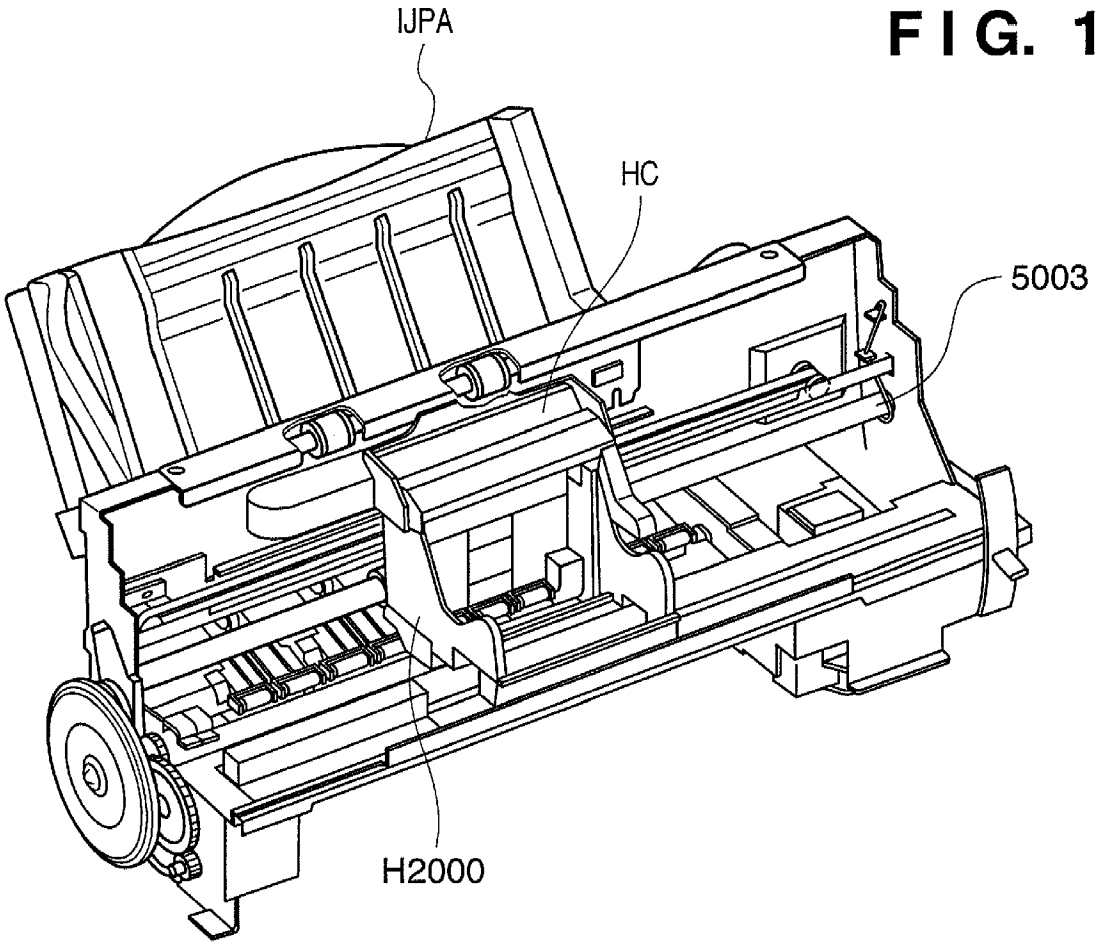
FIG. 19 shows an overview of another configuration of a common inkjet printing apparatus.

A printing apparatus shown in FIG. 19 will be described as another embodiment of the inkjet printing apparatus. The outer covering of the printing apparatus (IJPA) in FIG. 19 has been removed, and only the main internal portions will be described. Printing is performed when the carriage (HC) moves in the main scan direction along the guide rail 5003. A tank holder H2000 is mounted to the guide rail 5003. The ink tanks are detachable in relation to the tank holder.

Figure 5:
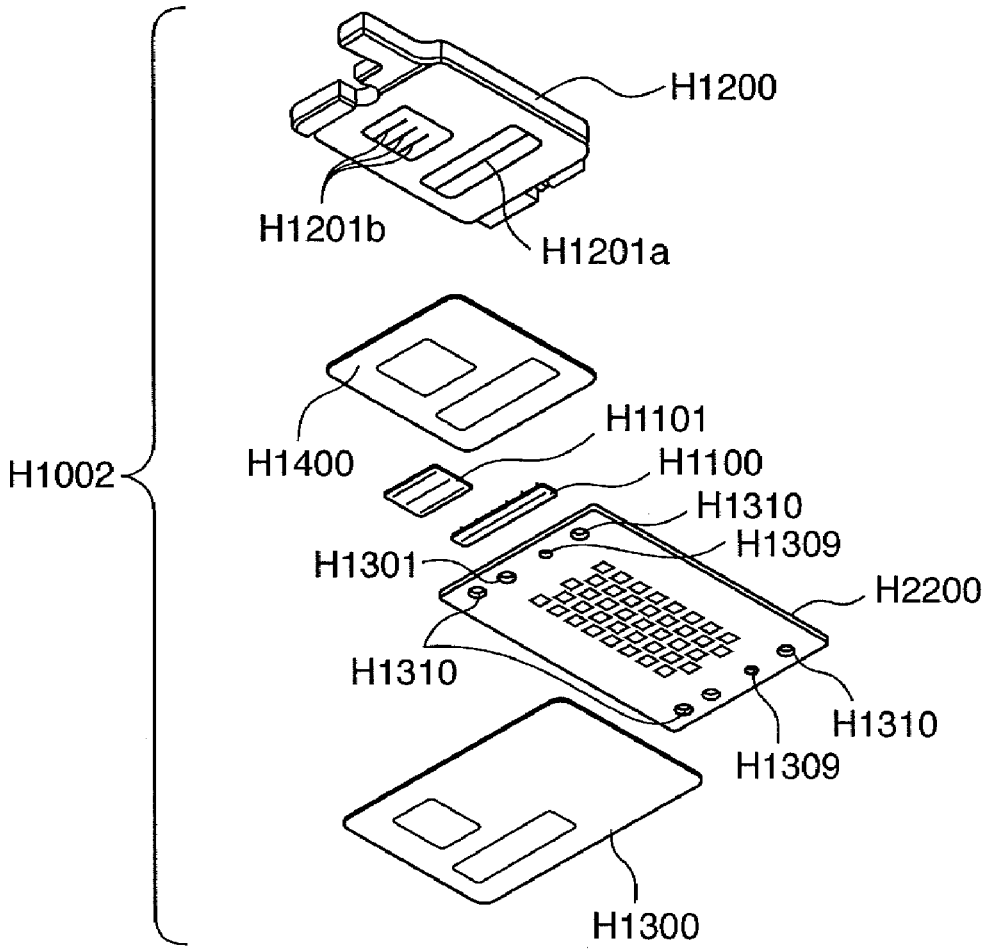
FIG. 5 is an exploded perspective view of the inkjet printhead from FIGS. 3A-B.
Figure 6:
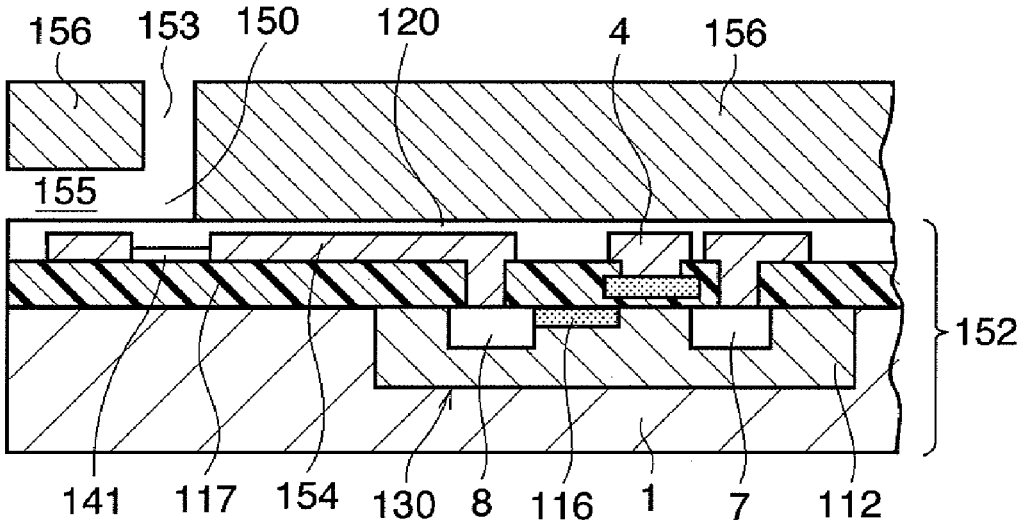
FIG. 6 PRIOR ART
FIG. 6 is a schematic cross-sectional view showing part of a conventional element substrate.
Figure 20:
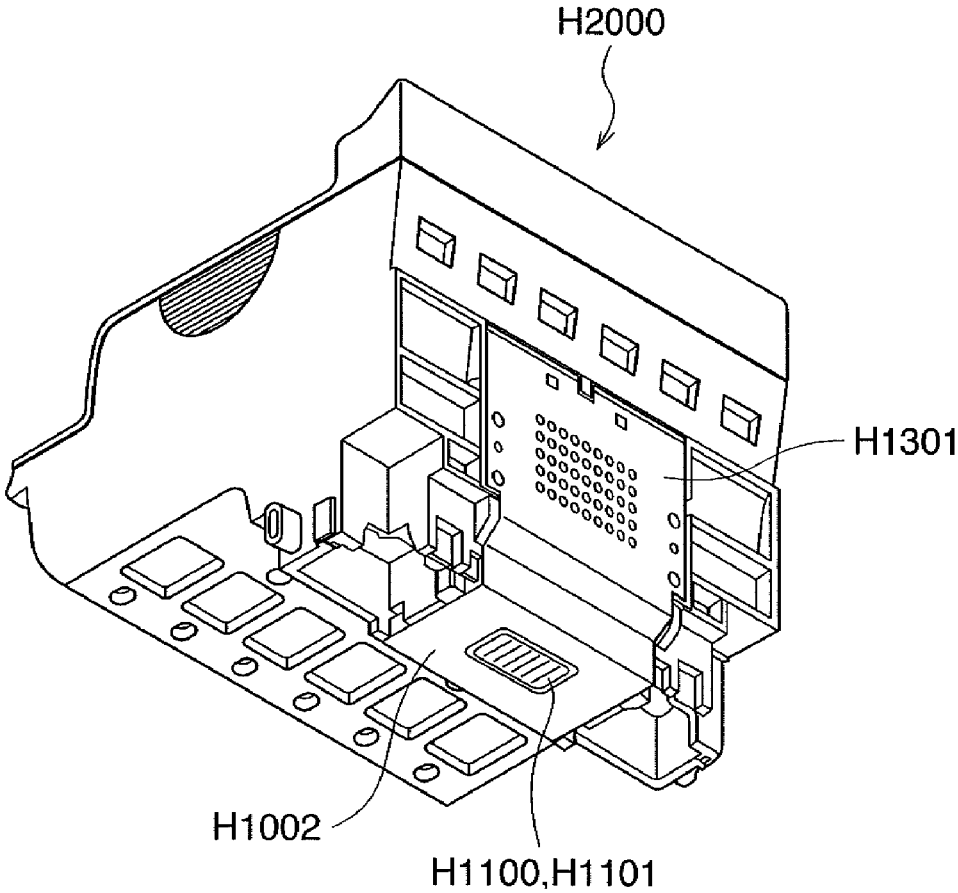
FIG. 20 is an illustrative view showing the configuration of a printing element substrate in the inkjet printing apparatus.

FIG. 20 is a perspective view of the tank holder H2000 seen from the underside of the printing apparatus. The tank holder is provided with an external signal input terminal 1301 that receives electrical signals from the inkjet printing apparatus, a printing element unit H1002, and printing element substrates H1100 and H1101. With the element substrates in FIG. 20, a configuration is shown in which discharge orifices that discharge black ink and discharge orifices that discharge color ink are integrally formed on a single substrate. However, the printing element substrates may be configured so that the color ink element substrate H1100 is separate from the black ink element substrate H1101 as shown in FIG. 5.

Exemplary Printhead

Figure 3B:
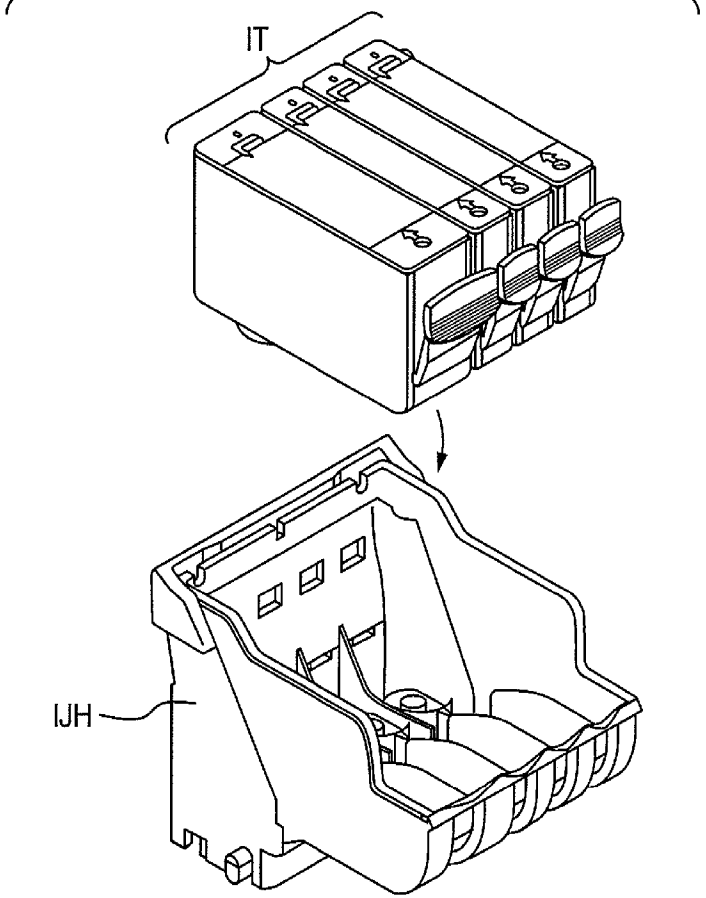
FIGS. 3A and 3B are perspective views of an example inkjet printhead.
Figure 3A:
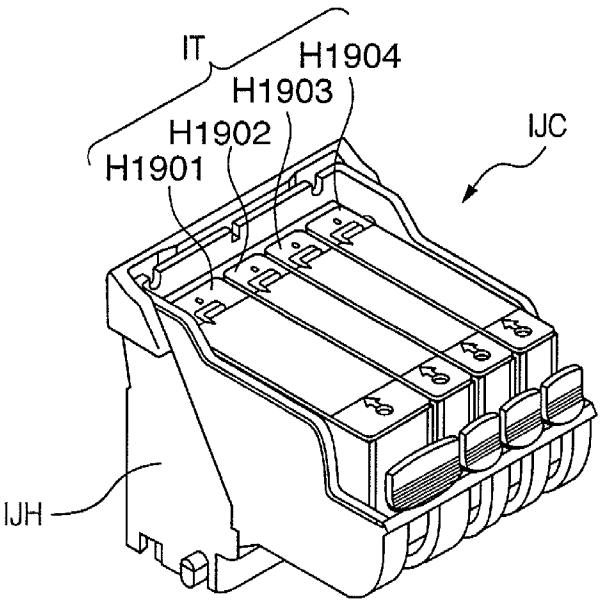

Next, an example inkjet printhead will be described. The inkjet printhead IJH of the embodiments of the present invention is one of the elements constituting a head cartridge IJC, as seen from the perspective views of FIGS. 3A and 3B. This head cartridge IJC is constituted by the printhead IJH, and the ink tanks IT (H1901, H1902, H1903, H1904) detachably provided on the printhead IJH. The printhead IJH discharges ink (printing liquid) supplied from the ink tanks IT, from a discharge orifice according to print information.

This head cartridge IJC is fixedly supported by an electrical contact point and a positioning unit of the cartridge HC set on the inkjet printing apparatus IJPA, and is detachable with respect to the cartridge HC.

Figure 4:
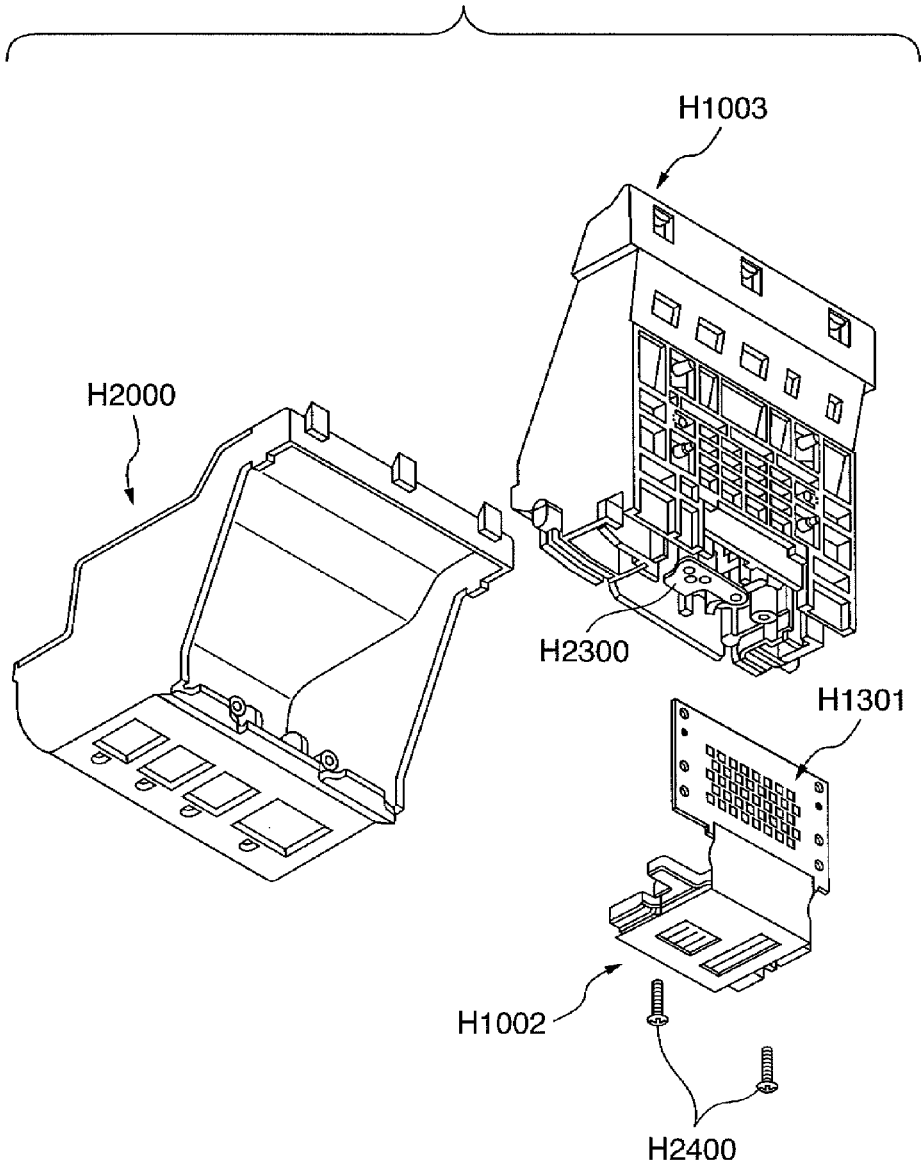
FIG. 4 is an exploded perspective view of the inkjet printhead from FIGS. 3A-B.

As shown in the exploded perspective view of FIG. 4, the printhead IJH is constituted by a printing element unit H1002, an ink supply unit (printing liquid supply unit) H1003, and a tank holder H2000. Note that the printhead IJH needs to allow the ink communication ports of the printing element unit H1002 and the ink communication ports of the ink supply unit H1003 to communicate such that ink does not leak. The respective members are thus fixed with screws H2400 via a joint sealing member H2300 so as to be pressure bonded.

As shown in FIG. 4, H1301 denotes a plurality of external signal input terminals for inputting external signal to a printing element unit H1002.

As shown in the exploded perspective view of FIG. 5, a first printing element substrate H1100 for discharging black ink is adhered and fixed to a first plate H1200. Further, the first plate H1200 is adhered and fixed to a second plate H1400 having openings. This second plate H1400 is adhered and fixed to an electrical wiring tape H1300 using a TAB method, and positioned in relation to the first printing element substrate H1100. This electrical wiring tape H1300 applies an electrical signal for discharging ink to the first printing element substrate H1100, and includes electrical wiring that corresponds to the first printing element substrate H1100. The electrical wiring tape H1300 is connected to an electrical contact substrate H2200 having an external signal input terminal H1301 that receives electrical signals from the inkjet printing apparatus. The electrical contact substrate H2200 is positioned and fixed on the ink supply unit H1003 using terminal positioned holes H1309 (two).

It is noted that the electrical contact substrate H2200 may be provided with a positioned hole H1310 as necessary.

The second printing element substrate H1101 is for discharging color ink of three colors. The first plate H1200 has formed thereon an ink communication port H1201*a* for supplying black ink to the first printing element substrate H1100, and ink communication ports H1201*b* for supplying cyan, magenta and yellow ink to the second printing element substrate H1101.

Exemplary Head Cartridge

Figure 17:
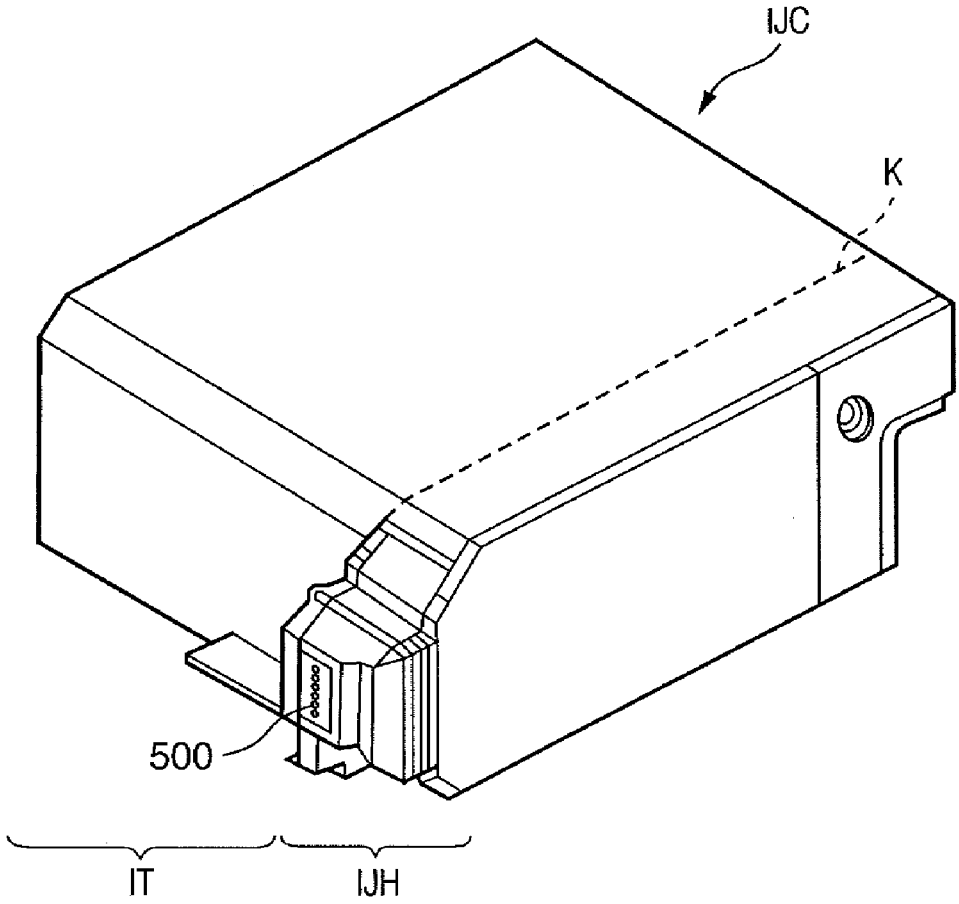
FIG. 17 is a perspective view of a common head cartridge.

FIG. 17 is an external perspective view showing an example configuration of the head cartridge IJC in which the ink tanks and the printhead are integrally formed. In FIG. 17, the dotted line K marks the boundary line between the ink tanks IT and the printhead IJH. An electrode (not shown) for receiving an electrical signal supplied from the cartridge HC when the head cartridge IJC is mounted on the cartridge HC is provided in the head cartridge IJC. The printhead IJH is then driven and ink is discharged as a result of this electrical signal, as described above. Also, reference numeral 500 denotes an ink discharge orifice array.

First Exemplary Embodiment

Figure 7:
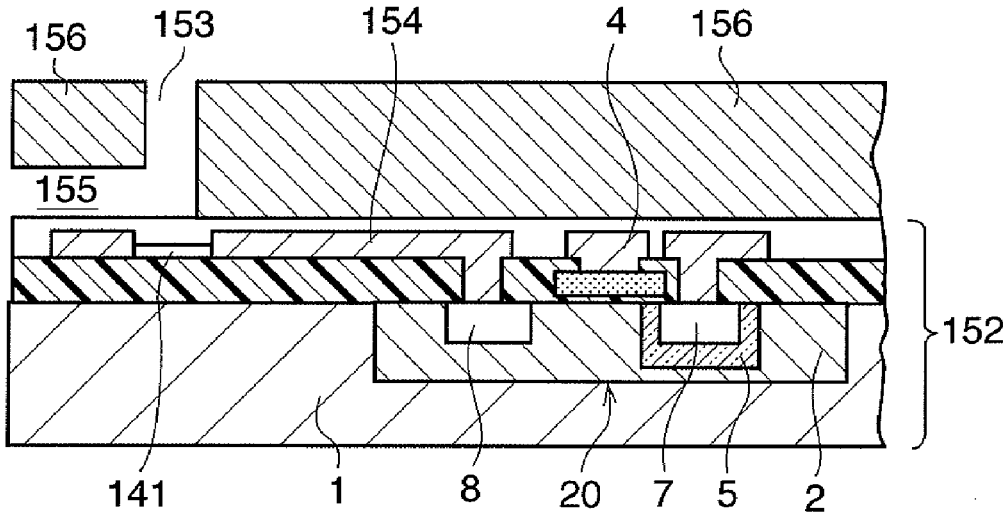
FIG. 7 PRIOR ART
FIG. 7 is a schematic cross-sectional view showing part of a conventional element substrate.
Figure 8:
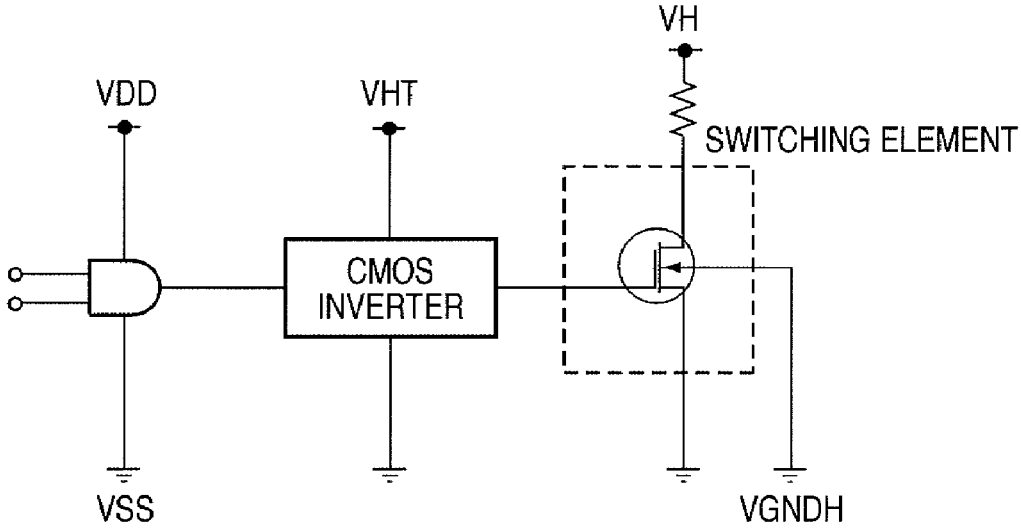
FIG. 8 PRIOR ART
FIG. 8 illustrates a method of transmitting a drive signal in common driver IC.
Figure 9:
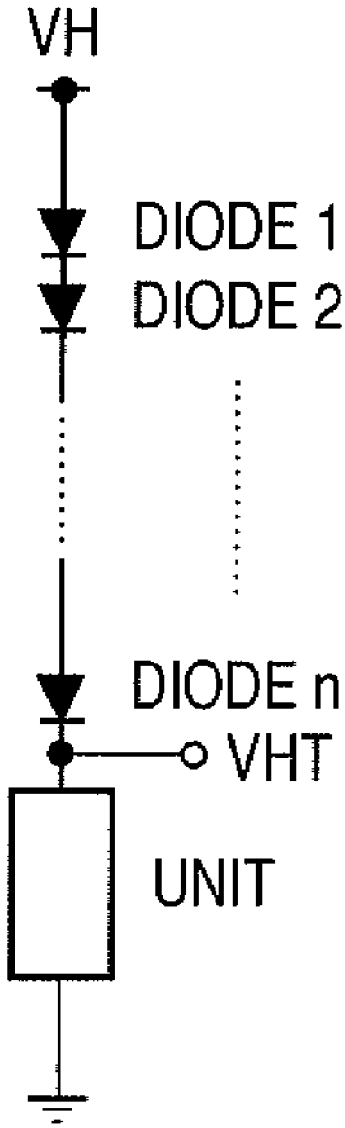
FIG. 9 PRIOR ART
FIG. 9 shows an exemplary level shift circuit.
Figure 10:
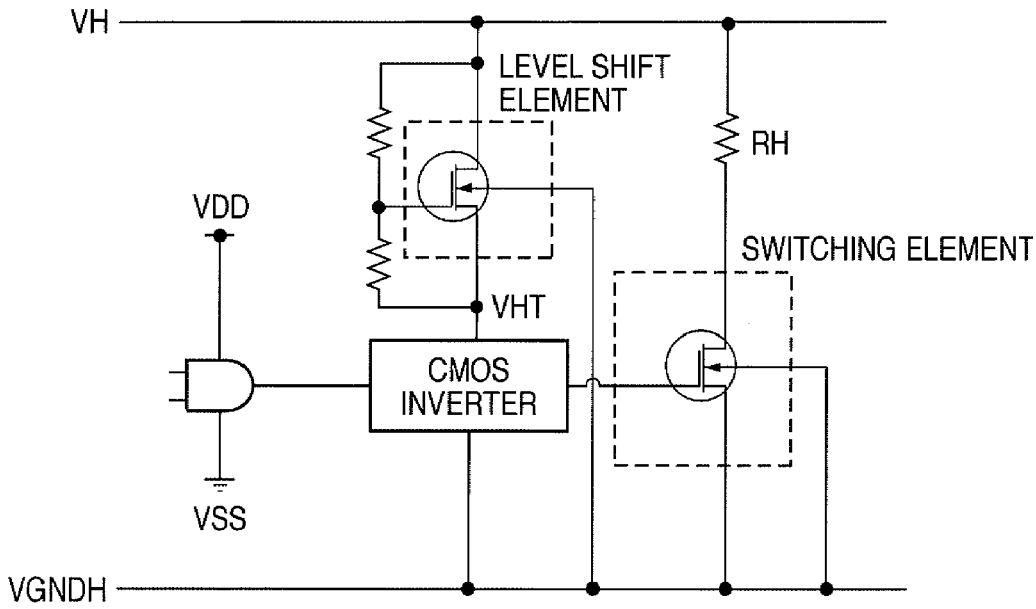
FIG. 10 PRIOR ART
FIG. 10 shows a conventional source follower type level shift circuit.
Figure 11:
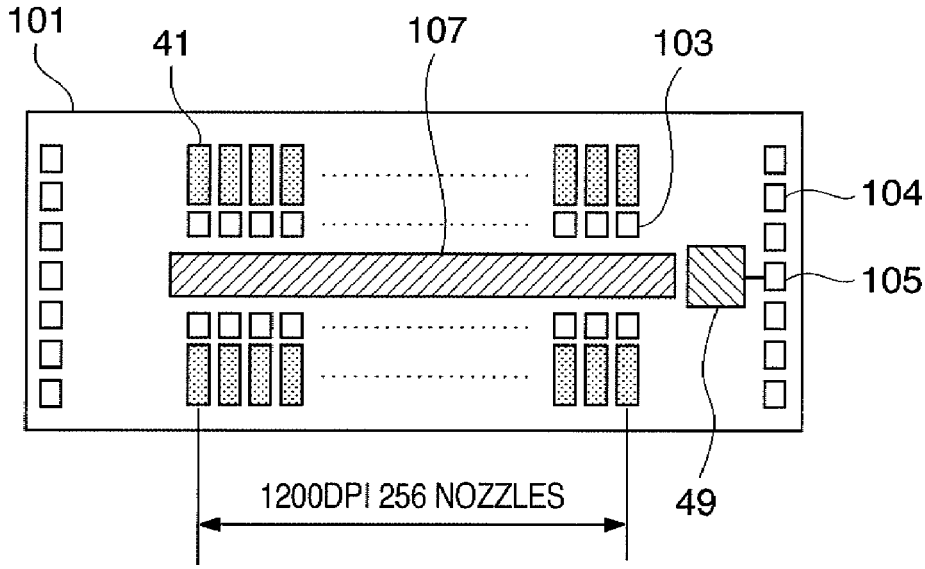
FIG. 11 PRIOR ART
FIG. 11 is a top view showing an exemplary arrangement of elements on an element substrate.
Figure 12:
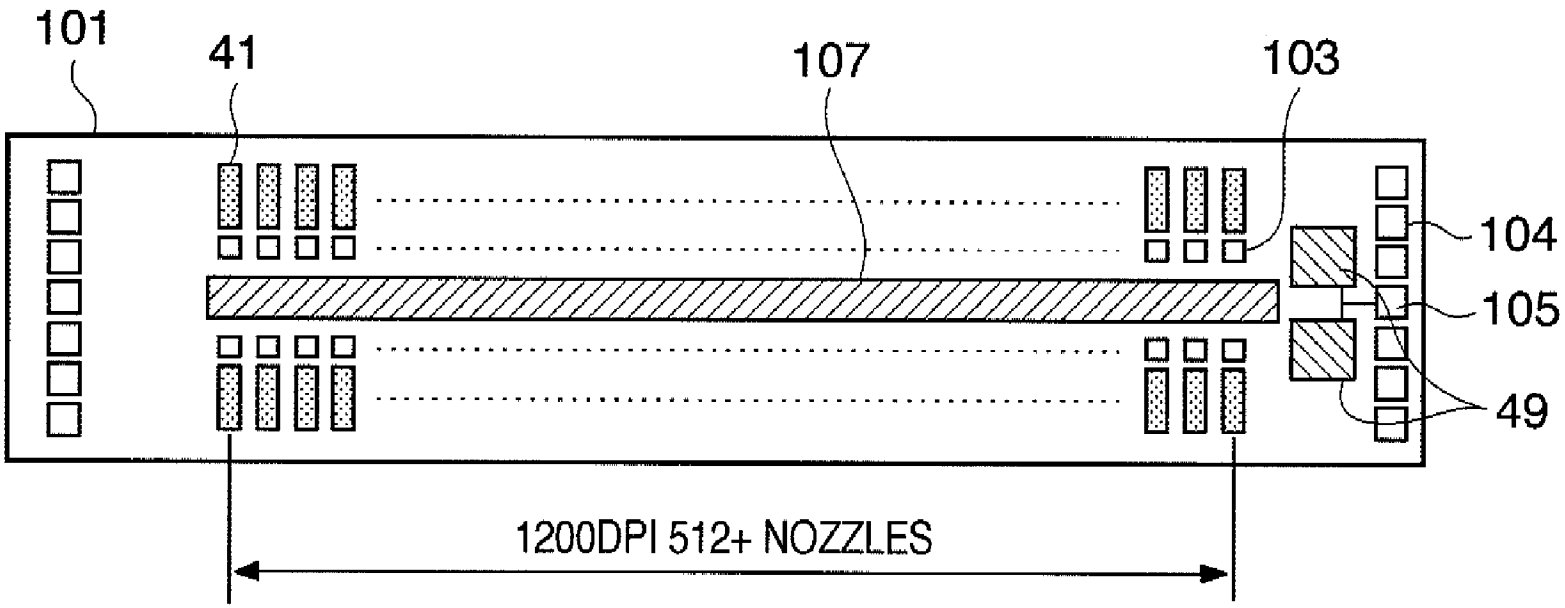
FIG. 12 PRIOR ART
FIG. 12 is a top view showing an exemplary arrangement of elements on an element substrate.
Figure 13:
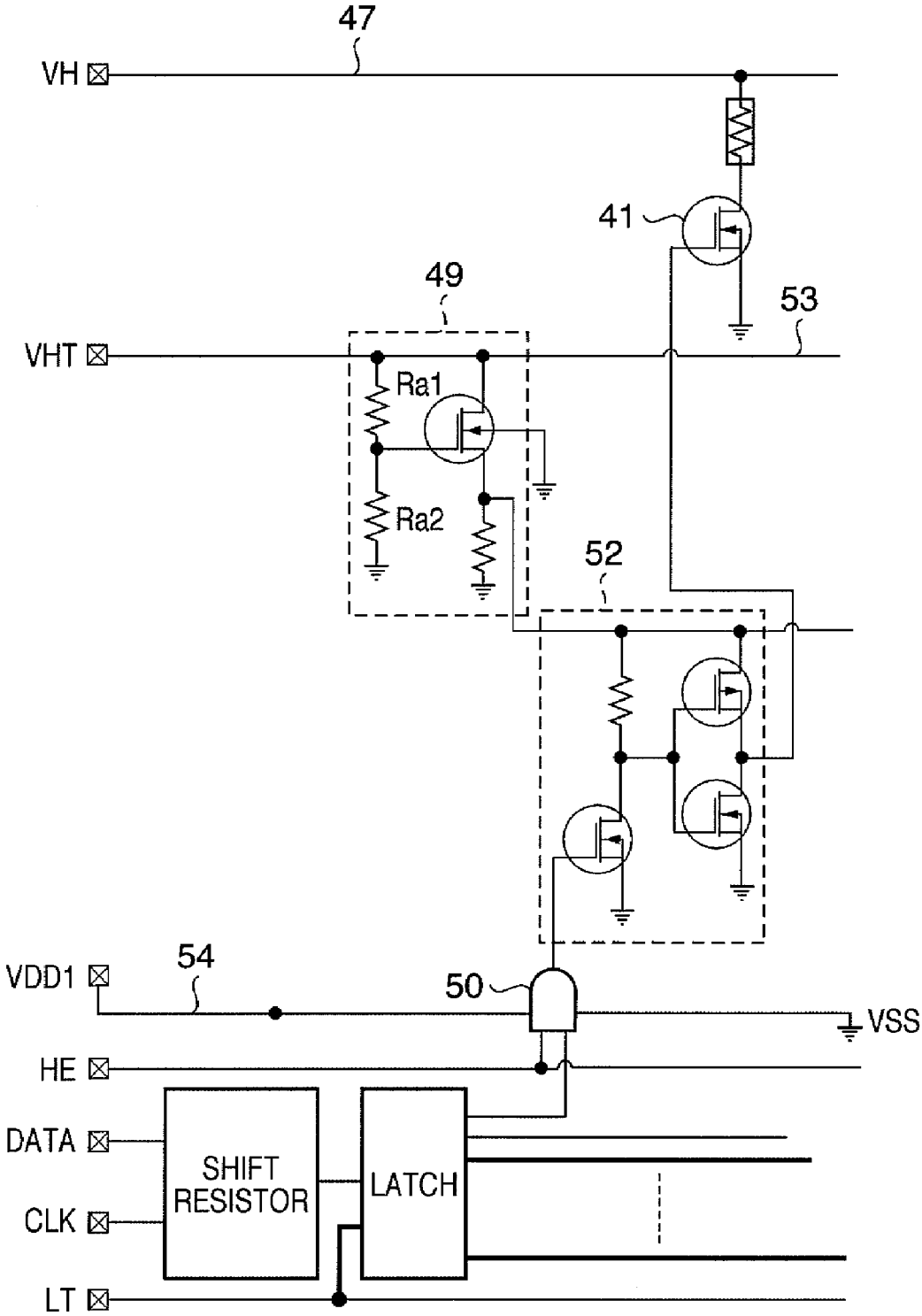
FIG. 13 PRIOR ART
FIG. 13 shows a circuit configuration configured on a conventional element substrate.
Figure 16:
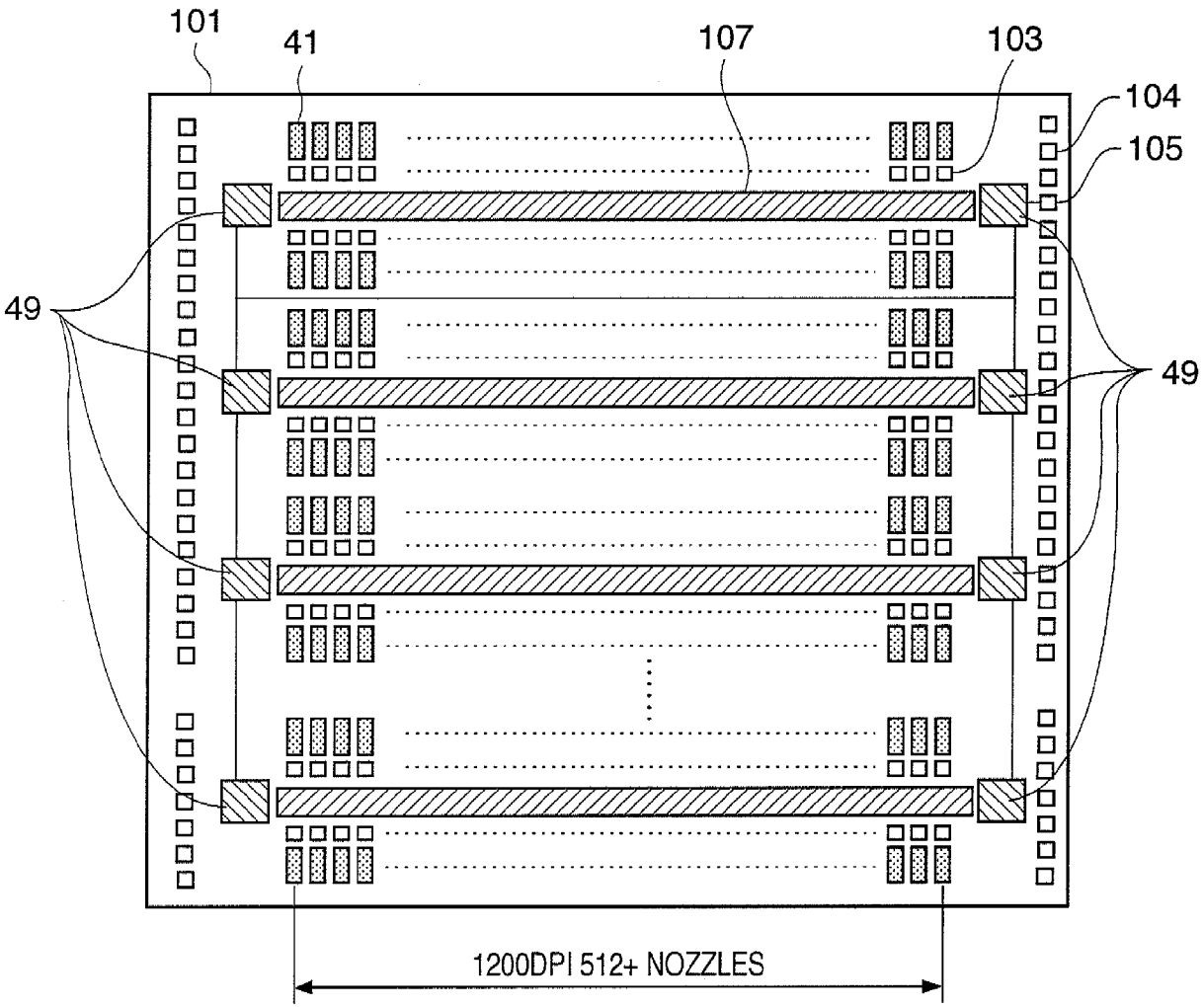
FIG. 16 is a top view showing an embodiment of the arrangement of elements on an element substrate.

FIG. 16 is a top view showing the arrangement of elements on an element substrate for an inkjet printhead according to a first exemplary embodiment of the present invention. An element substrate 101 has formed thereon switching elements 41, which are DMOS transistors, and electrothermal transducers 103 having the configurations shown in FIG. 7, and level shift circuits 49 which include a level shift element such as shown in FIG. 10. The element substrate 101 also has formed thereon a plurality of pads (terminals) 104, level shift circuit input voltage pads 105 utilized for receiving supply of input voltages for the level shift circuits 49 and drive signals for the switching elements 41 from an external source, and ink supply port forming portions 107.

The switching elements 41 and the electrothermal transducers 103 are provided in two rows over a 1200 dpi (dots per inch) interval with the ink supply port forming portions 107 sandwiched therebetween. Each row has at least 512 switching elements 41 and electrothermal transducers 103. Ink channels (not shown) are formed on the ink supply port forming portions 107 and the electrothermal transducers 103. The element substrate 101 is combined with a top plate (not shown), and ink discharge orifices are formed in the top plate at positions corresponding to the electrothermal transducers 103. Heating the electrothermal transducers 103 by applying a voltage thereto causes ink on the electrothermal transducers 103 to foam and be discharged from the discharge orifices as a result of this energy.

A plurality of sets each composed of an ink supply port forming portion 107, switching elements 41 formed so as to oppose one another with the ink supply port forming portion 107 sandwiched therebetween, and electrothermal transducers 103 are arranged in parallel. An input voltage is supplied to each level shift circuit 49 from an external source via a corresponding level shift circuit input voltage pad 105 provided on the element substrate 101.

LT denotes a latch signal input terminal which loads data from a shift register circuit and latches data in a latch circuit. CLK denotes an input terminal for clock signal. DATA denotes an input terminal for data relating a printing. HE denotes an input terminal for heat signal turning ON/OFF of a heater by a controlled pulse width. VSS denotes a terminal wired for a ground. Each reference sign of the respective terminals denote the same in the following figures.

Next, an example circuit configuration of the present embodiment will be described in detail using FIG. 1. In FIG. 1, reference numeral 54 denotes a first logic circuit voltage (VDD1), which is a first voltage utilized during normal operation. This voltage is input to a first terminal from an external source, and input to a logic circuit via a first wiring connected from the first terminal to the logic circuit. Reference numeral 55 denotes a second logic circuit voltage (VDD2) as a preliminary voltage, which is a second voltage that is capable of operating the logic circuit but does not contribute to the operation of the logic circuit during normal operation. Reference numeral 56 denotes a diode as a preliminary voltage application control circuit, and Ra1 to Ra4 respectively denote resistors used in voltage step-down by resistance ratio division.

First, assume that a third voltage (VHT) input from a level shift circuit input voltage pad utilized as a second terminal in the present embodiment is 24V, for example. The voltage is stepped down using resistance ratio division, with the resistors set so that Ra1:Ra2=1:1 to give a drive voltage input to the switching element 41 of 12V. The logic voltage of the logic signal output from the logic circuit is applied to the switching element 41 after being stepped up to this 12V by the level converter 52. Note that because the voltage is fixed, current consumption is considered to increase when an element with a low resistance value is utilized. Therefore, elements (e.g., Poly-Si resistors, etc.) that can be set to as high a resistance value as possible are preferably utilized in order to suppress power consumption. A switching element drive voltage 53 is then supplied to the level shift circuit 49 by the source follower.

Next, in the system for generating the second logic circuit voltage 55 (VDD2) from the input voltage (VHT) to the level shift circuit 49, the voltage is stepped down using resistance ratio division by Ra3 and Ra4, with these resistors being used as a preliminary voltage input circuit. For example, the resisters are set so that Ra3:Ra4=7:1, to give a second logic circuit voltage 55 of 3.0V relative to the above 24V input voltage. Note that as previously mentioned, because the voltage is fixed, current consumption is considered to increase if the resistance value is low. Therefore, elements (e.g., Poly-Si resistors, etc.) that can be set to as high a resistance value as possible are preferably utilized. Note that the diode 56 utilized as a preliminary voltage application control circuit is disposed on a second wiring that is connected from the preliminary voltage input circuit (Ra3, Ra4) to the first wiring.

Since the first logic circuit voltage 54 (e.g., 3.3V) operates during normal operation, the second logic circuit voltage 55 is set to a voltage of 3.3V or less so as not to operate during normal operation. Also, the first logic circuit voltage 54 is set as the cathode and the second logic circuit voltage 55 is set as the anode.

In the present embodiment, "normal operation" refers to the case where the first logic circuit voltage is functioning normally. Assuming that the voltage (3.3V) of the diode 56 in FIG. 1 is a reference voltage, the second logic circuit voltage will function if it is judged that normal operation is not being performed in the case where the voltage falls below this reference voltage.

In the present embodiment, the second logic circuit voltage 55 is set to 3.0V, although another voltage can be applied as the second logic circuit voltage provided it satisfies the above requirements. The second logic circuit voltage 55 is supplied as a countermeasure for when the normal first logic circuit voltage 54 cannot be supplied for whatever reason. The second logic circuit voltage 55 is thus purposely set to a low level at which ink cannot be discharged, and is supplied at a level that is merely intended to stabilize the logic of the logic circuit and prevent the element substrate from getting out of control or the printhead from being damaged. The second logic circuit voltage 55 is, however, not limited to such a voltage.

Second Exemplary Embodiment

Figure 2:
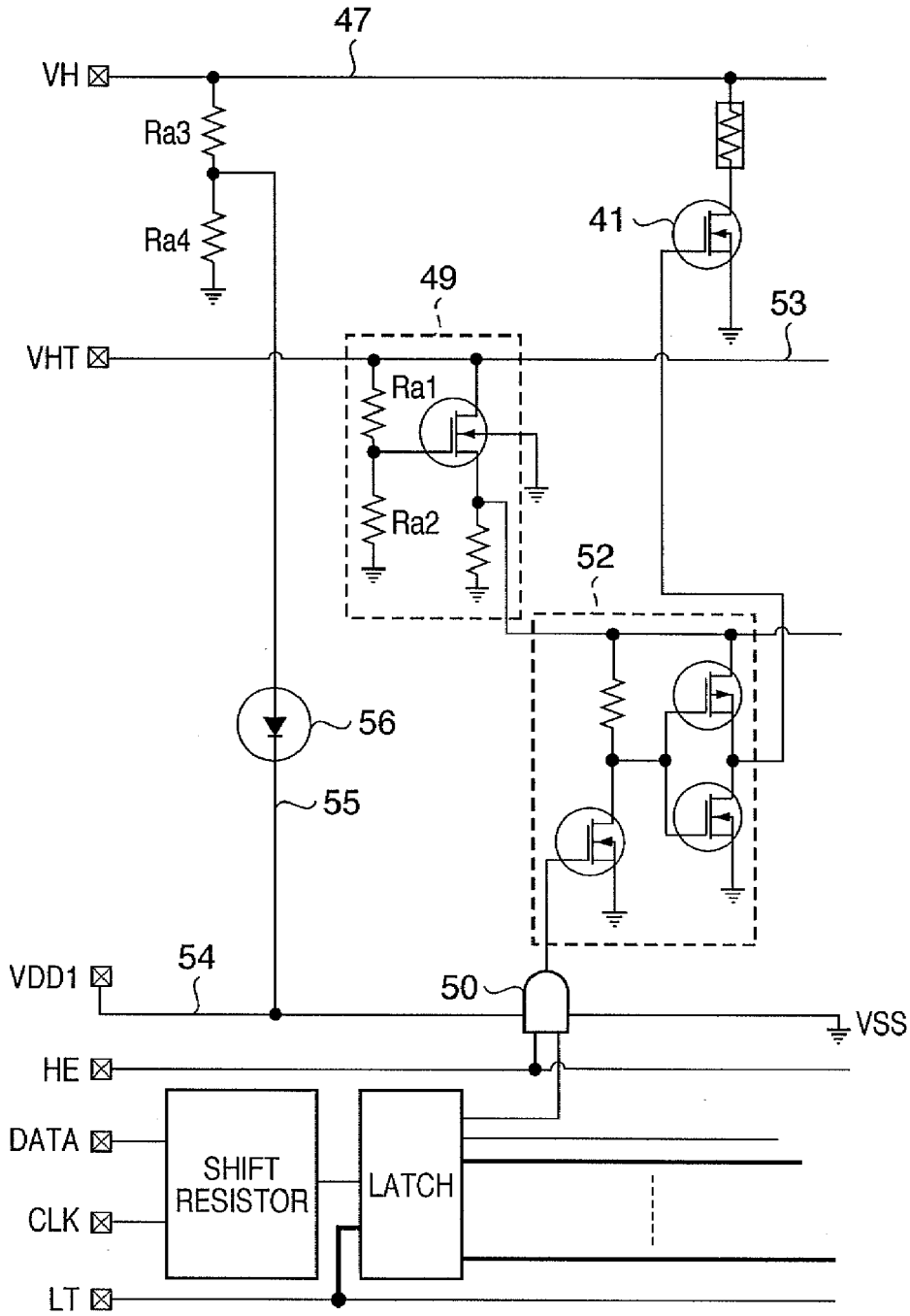
FIG. 2 shows an example circuit configuration according to a second exemplary embodiment of the present invention.

Next, an example circuit configuration of the second exemplary embodiment will be described in detail using FIG. 2. FIG. 2 shows a circuit configuration in the case where a second logic circuit voltage 55 that does not operate during normal operation is generated from a power supply voltage 47 (VH) which is the drive voltage of an electrothermal transducer and allows current to flow to the electrothermal transducer. In this configuration, the power supply voltage 47 is also stepped down between Ra3 and Ra4 using resistance ratio division in order to generate the second logic circuit voltage 55. For example, assume to the power supply voltage 47 is 24V. The VH terminal in FIG. 2 is a printing element drive voltage input terminal.

Given that the first logic circuit voltage 54 (e.g., 3.3V) operates during normal operation, the second logic circuit voltage 55 generated by resistance division is set to 3.3V or less relative to this voltage, so as to not contribute to the operation of the logic circuit during normal operation. In the present embodiment, the resistors are set so that Ra3:Ra4=7:1, to give a second logic circuit voltage of 3.0V. Also, the first logic circuit voltage 54 is set as the cathode and the second logic circuit voltage 55 is set as the anode. Note that because the voltage is fixed, current consumption is considered to increase if the resistance value is low, similarly to embodiment 1. Therefore, elements (e.g., Poly-Si resistors, etc.) that can be set to as high a resistance value as possible are preferably utilized.

Third Exemplary Embodiment

Figure 18:
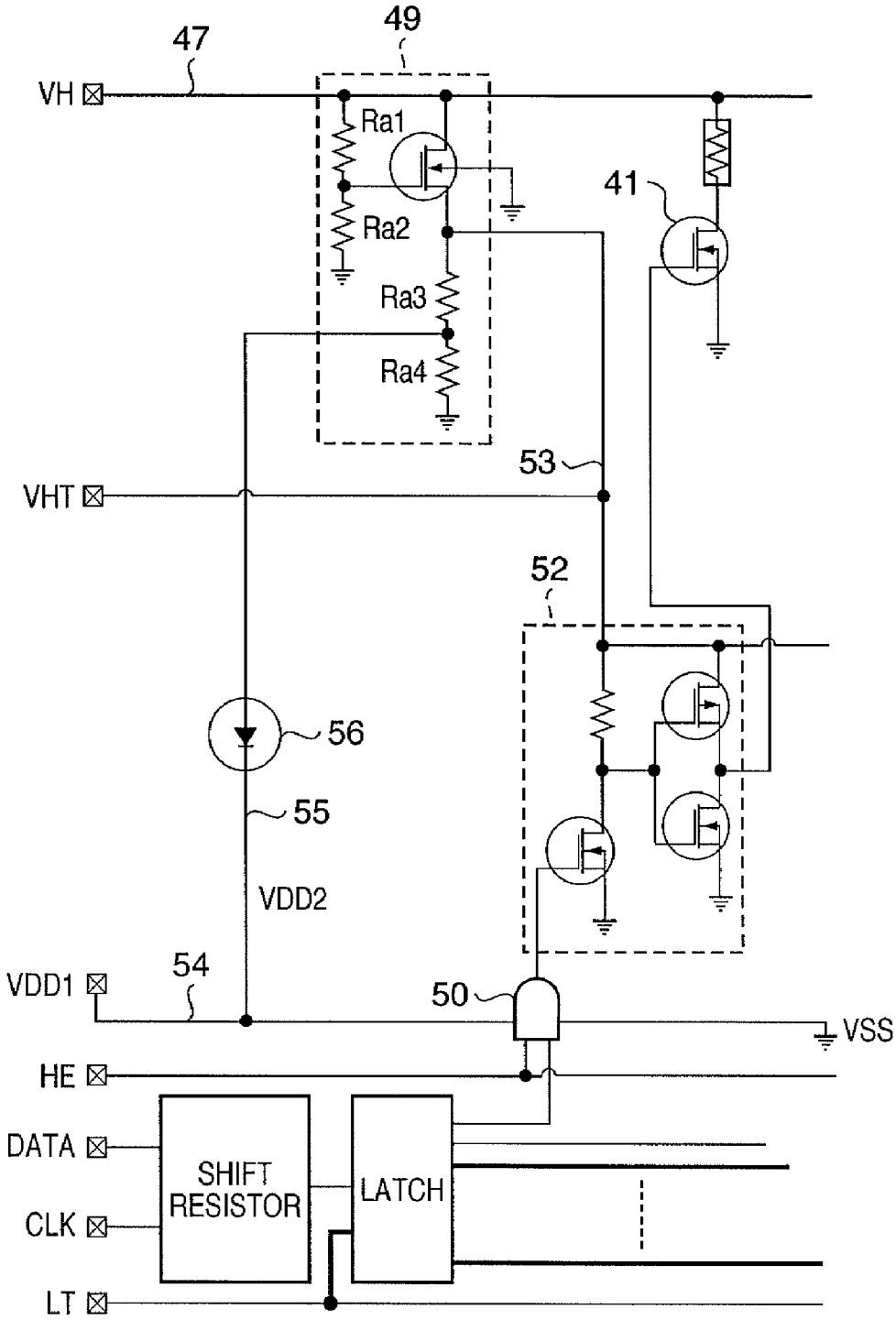
FIG. 18 shows an example circuit configuration according to a third exemplary embodiment of the present invention.

Next, an example circuit configuration of the third exemplary embodiment will be described in detail using FIG. 18. FIG. 18 shows a circuit configuration embodiment in the case where a second logic circuit voltage 55 that does not contribute to the operation of the logic circuit during normal operation is generated from a power supply voltage 47 for allowing current to flow to an electrothermal transducer, using part of the configuration of the level shift circuit 49. In FIG. 18, the VH terminal is a printing element drive voltage input terminal.

First, assume the input voltage from the level shift circuit input voltage pad is 24V, for example. The voltage is stepped down by resistance ratio division for use in the source follower, with the resistors set so that Ra1:Ra2=1:1 to give an input voltage (VHT) to the switching element 41 of 12V. Note that because the voltage is fixed, current consumption is considered to increase if an element with a low resistance value is utilized. Therefore, elements (e.g., Poly-Si resistors, etc.) that can be set to as high a resistance value as possible are preferably utilized in order to suppress power consumption. The voltage (VHT) for driving the switching element 41 is then supplied by the source follower.

Next, resistance ratio division is also performed on the voltage VHT supplied by the source follower between Ra3 and Ra4 in the level shift circuit. For example, the resistors are set so that Ra3:Ra4≈3:1 to give a second logic circuit voltage 55 of 3.0V relative to the 12V input voltage to the switching element 41. Note that as previously mentioned, because the voltage is fixed, current consumption is considered to increase if the resistance value is low. Therefore, elements (e.g., Poly-Si resistors, etc.) that can be set to as high a resistance value as possible are preferably utilized.

Since the first logic circuit voltage 54 (e.g., 3.3V) operates during normal operation, the second logic circuit voltage 55 is set to a voltage of 3.3V or less so as to not operate during normal operation. Also, the first logic circuit voltage 54 is set as the cathode and the second logic circuit voltage 55 is set as the anode. Further, a rectification diode 56 is disposed so as to satisfy the relation "second logic circuit voltage<first logic circuit voltage", to ensure that the second logic circuit voltage 55 does not operate during normal operation.

In the present embodiment, the second logic circuit voltage 55 is set to 3.0V, although another voltage is acceptable provided it satisfies the above requirements. The second logic circuit voltage 55 is supplied as a countermeasure for when the normal first logic circuit voltage 54 cannot be supplied for whatever reason. The second logic circuit voltage is thus purposely set to a low level at which ink cannot be discharged, and is supplied at a level that is merely intended to stabilize the logic of the logic circuit. The second logic circuit voltage 55 is, however, not limited to such a voltage.

Other Exemplary Embodiments & Term Definitions

While the embodiments of the present invention have been illustrated above, configurations adapted according to chip size, layout or the like can be utilized in combination.

Apart from adopting the form of an apparatus provided integrally or separately as the image output terminal of an information processing device such as a computer, the printing apparatus according to the present invention may adopt the form of a copy apparatus in combination with a reader or the like, or a facsimile apparatus having a transmit or receive function.

The foregoing embodiments were described using the example of an element substrate for an inkjet printhead, although an element substrate for a thermal transfer printhead, a dye sublimation printhead or the like can be used.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in a common printing apparatus, but also broadly includes materials, such as cloth, a plastic film, a metal plate, glass, ceramics, wood, and leather, capable of accepting ink.

Furthermore, the term "ink" (also referred to as a "liquid" hereinafter) should be extensively interpreted similarly to the definition of "print" described above. That is, "ink" includes a liquid which, when applied onto a print medium, can form images, figures, patterns and the like, can process the print medium and can process ink (e.g., can solidify or insolubilize a coloring agent contained in ink applied to the print medium).

Note that the term "element substrate" used in description indicates the base on which various elements, wiring, and the like are provided, rather than merely referring to a base composed of a silicon semiconductor.

The phrase "on the element substrate" refers not only to "on the surface of the element substrate", but also indicates inner portions of the element substrate in proximity to the surface. Also, the term "built-in" in the present invention indicates integrally forming or manufacturing various elements on a heater substrate using manufacturing processes for a semiconductor circuit or the like, rather than merely referring to the arrangement of individual elements on a base.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-121161, filed May 1, 2007, and Japanese Patent Application No. 2008-088263, filed Mar. 28, 2008, which are hereby incorporated by reference herein in their entirety.

What is claimed is:

1. An element substrate comprising:

a printing element;

an input terminal configured to input a drive voltage of the printing element;

a switching element configured to drive the printing element;

a logic circuit configured to output a drive signal to the switching element, and operable if a first voltage is applied;

a first terminal configured to externally apply the first voltage to the logic circuit;

an input circuit configured to output a second voltage based on a third voltage; and a control circuit configured to output a preliminary voltage based on the second voltage to the logic circuit when the first voltage is not externally applied to the first terminal, wherein the third voltage is inputted independently of the drive voltage.

2. The element substrate according to claim 1, further comprising:

a first conductive line connected from the first terminal to the logic circuit, and a second conductive line connected from the input circuit to the first conductive line, wherein the control circuit is provided with the second conductive line.

3. The element substrate according to claim 1, further comprising a second terminal configured to input the third voltage for generating a drive voltage of the switching element, wherein the input circuit has a plurality of resistors, and generates the second voltage by stepping down the third voltage input from the second terminal, using resistance division by the plurality of resistors.

4. The element substrate according to claim 1, wherein the input circuit has a plurality of resistors, and generates the second voltage by stepping down the drive voltage of the printing element input from the input terminal, using resistance division by the plurality of resistors.

5. The element substrate according to claim 1, wherein the input circuit has a plurality of resistors, and generates the second voltage and a drive voltage of the switching element by stepping down the drive voltage of the printing element input from the input terminal, using resistance division by the plurality of resistors.

6. The element substrate according to claim 1, wherein the switching element is a DMOS transistor.

7. A printhead comprising:

an element substrate, wherein the element substrate comprises:

a printing element;

an input terminal configured to input a drive voltage of the printing element;

a switching element configured to drive the printing element;

a logic circuit configured to output a drive signal to the switching element, and operable if a first voltage is applied;

a first terminal configured to externally apply the first voltage to the logic circuit;

an input circuit configured to output a second voltage based on a third voltage; and a control circuit configured to output a preliminary voltage based on the second voltage to the logic circuit when the first voltage is not externally applied to the first terminal, wherein the third voltage is inputted independently of the drive voltage.

8. A head cartridge comprising:

an ink tank containing ink; and a printhead having an element substrate, wherein the element substrate comprises:

a printing element;

an input terminal configured to input a drive voltage of the printing element;

a switching element configured to drive the printing element;

a logic circuit configured to output a drive signal to the switching element, and operable if a first voltage is applied;

a first terminal configured to externally apply the first voltage to the logic circuit;

an input circuit configured to output a second voltage based on a third voltage; and a control circuit configured to output a preliminary voltage based on the second voltage to the logic circuit when the first voltage is not externally applied to the first terminal, wherein the third voltage is inputted independently of the drive voltage.

9. A printing apparatus comprising:

a printhead having an element substrate, wherein the element substrate comprises:

a printing element;

an input terminal configured to input a drive voltage of the printing element;

a switching element configured to drive the printing element;

a logic circuit configured to output a drive signal to the switching element, and operable if a first voltage is applied;

a first terminal configured to externally apply the first voltage to the logic circuit;

an input circuit configured to output a second voltage based on a third voltage; and a control circuit configured to output a preliminary voltage based on the second voltage to the logic circuit when the first voltage is not externally applied to the first terminal, wherein the third voltage is inputted independently of the drive voltage to the element substrate.

10. The element substrate according to claim 1, wherein the control circuit is a diode.

11. The head cartridge according to claim 8, further comprising:

a first conductive line connected from the first terminal to the logic circuit, and a second conductive line connected from the preliminary voltage input circuit to the first conductive line, wherein the control circuit is provided with the second conductive line.

12. The head cartridge according to claim 8, further comprising a second terminal configured to input the third voltage for generating a drive voltage of the switching element, wherein the input circuit has a plurality of resistors, and generates the second voltage by stepping down the third voltage input from the second terminal, using resistance division by the plurality of resistors.

13. The head cartridge according to claim 8, wherein the input circuit has a plurality of resistors, and generates the second voltage by stepping down the drive voltage of the printing element input from the input terminal, using resistance division by the plurality of resistors.

14. The head cartridge according to claim 8, wherein the input circuit has a plurality of resistors, and generates the second voltage and a drive voltage of the switching element by stepping down the drive voltage of the printing element input from the input terminal, using resistance division by the plurality of resistors.

15. The head cartridge according to claim 8, wherein the switching element is a DMOS transistor.

16. The printing apparatus according to claim 9, further comprising:

a first conductive line connected from the first terminal to the logic circuit, and a second conductive line connected from the preliminary voltage input circuit to the first conductive line, wherein the control circuit is provided with the second conductive line.

17. The printing apparatus according to claim 9, further comprising a second terminal configured to input a third voltage for generating a drive voltage of the switching element, wherein the input circuit has a plurality of resistors, and generates the second voltage by stepping down the third voltage input from the second terminal, using resistance division by the plurality of resistors.

18. The printing apparatus according to claim 9, further comprising an input terminal configured to input a drive voltage of the printing element, wherein the input circuit has a plurality of resistors, and generates the second voltage by stepping down the drive voltage of the printing element input from the input terminal, using resistance division by the plurality of resistors.

19. The printing apparatus according to claim 9, wherein the input circuit has a plurality of resistors, and generates the second voltage and a drive voltage of the switching element by stepping down the drive voltage of the printing element input from the input terminal, using resistance division by the plurality of resistors.

20. The printing apparatus according to claim 9, wherein the switching element is a DMOS transistor.

* * * * *